United States Patent [19]

Irwin

[11] Patent Number: 4,686,732

[45] Date of Patent: Aug. 18, 1987

[54] WASTE LINE CLEANOUT APPARATUS

[76] Inventor: Lawrence F. Irwin, 12860 San Fernando Rd., Sylmar, Calif. 91342

[21] Appl. No.: 816,328

[22] Filed: Jan. 6, 1986

Related U.S. Application Data

[63] Continuation-in-part of Ser. No. 571,181, Jan. 19, 1984, Pat. No. 4,580,306.

[51] Int. Cl.[4] ..... B08B 9/02

[52] U.S. Cl. ..... 15/104.3 SN; 226/52

[58] Field of Search ..... 15/104.3 SN, 104.3 R; 226/52, 25; 74/25

[56] References Cited

U.S. PATENT DOCUMENTS

| | | | |
|---|---|---|---|
| 3,394,599 | 7/1968 | Tucker | 74/25 |
| 3,451,089 | 6/1969 | Carlson et al. | 15/104.3 SN |
| 3,882,565 | 5/1975 | Irwin et al. | 15/104.3 SN |
| 4,153,966 | 5/1979 | Irwin | 15/104.3 SN |
| 4,395,791 | 8/1983 | Irwin | 15/104.3 SN |

FOREIGN PATENT DOCUMENTS

| | | | |
|---|---|---|---|
| 770079 | 3/1954 | United Kingdom | 15/104.3 SN |

*Primary Examiner*—Edward L. Roberts
*Attorney, Agent, or Firm*—James E. Brunton

[57] ABSTRACT

A feed control device for use in conjunction with plumbing tools of the type used for cleaning and removing obstructions from waste lines in which an elongated coiled spring wire, or plumber's snake, is advanced through the pipe and rotated. The feed control device includes a novel snake feeding mechanism movable into and out of engagement with the snake and includes a biasing means for yieldably urging removably mounted feed rollers, which form a part of the feeding mechanism, into driving engagement with the snake. A unique feature of the invention resides in the design of the feed roller holder assembly which permits the selection of rollers having either smooth peripheral surfaces, or, alternatively, surfaces having helical grooved formed therein. When the smooth rollers are used the rollers can be rotated within the holder assembly so that the snake can be driven forwardly or in reverse. With this arrangement the device can be used for a wide variety of sewer cleanout operations for cleaning out various types of blockages.

8 Claims, 10 Drawing Figures

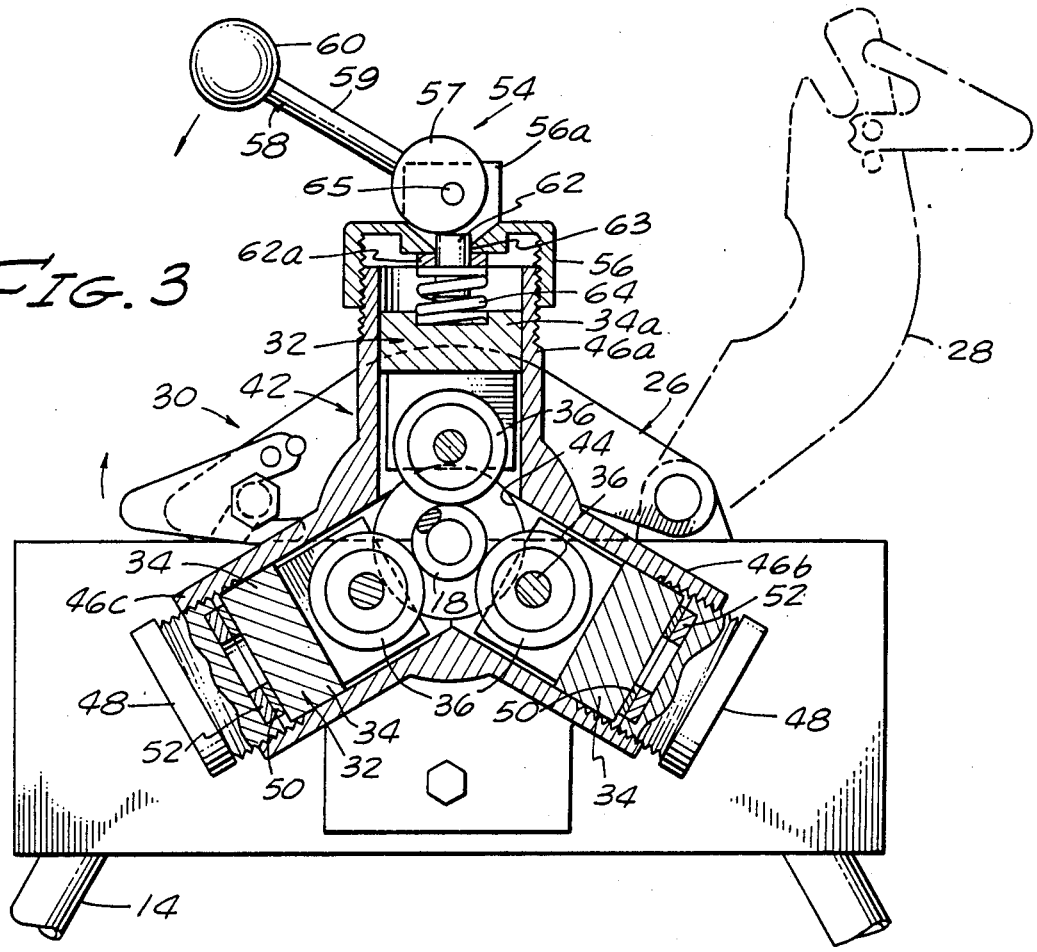
FIG. 3
FIG. 4
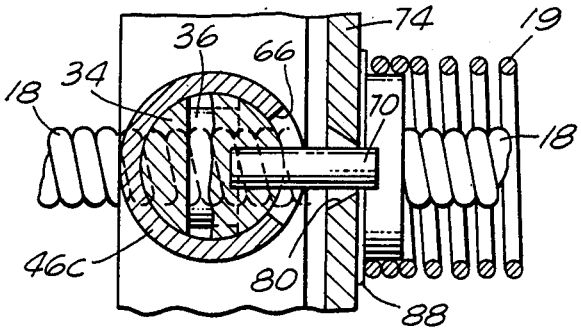
FIG. 5.
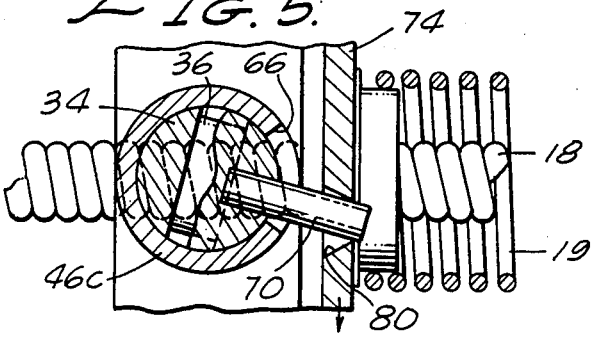
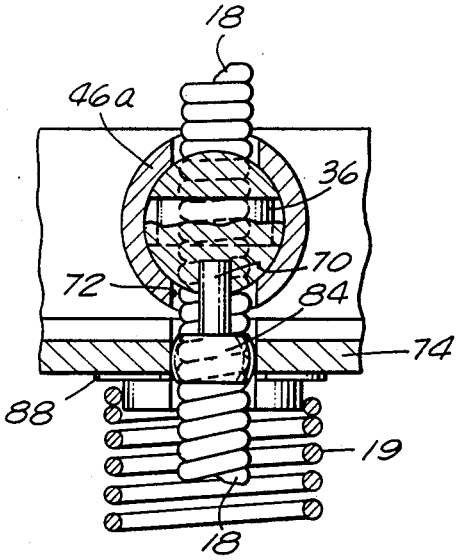
FIG. 6

WASTE LINE CLEANOUT APPARATUS

This is a continuation-in-part application of copending application Ser. No. 06/571,181, filed Jan. 19, 1984, now U.S. Pat. No. 4,580,306.

BACKGROUND OF THE INVENTION

1. Field of the Invention

The present invention relates generally to plumber's tools. More particularly the invention concerns a waste line cleanout tool adapted for cleaning an removing obstructions from waste lines wherein an elongated member in the form of a coiled spring wire, known as a plumber's snake is advanced through the pipe and rotated.

2. Discussion of the Prior Art

Spring-type plumber's snakes are ordinarily housed in a drum or container having a conoidal wall through which the spring or snake is fed and retracted axially of itself as the container is rotated to cause rotation of the spring. In conventional tools having power-operated spring advancing and retracting means, the feed mechanism typically includes a jaw in the form of a segmented nut, or the like, through which the spring is fed by rotating it so that, in effect, the spring is threaded through the jaw.

Various attempts have been made in the past to design a spring feed device which improves upon this fixed feed nut type arrangement and enables the operator to quickly stop the feed should a blockage be encountered within the pipe so as to avoid kinking of the spring and possible injury to the operator. Among the most successful of these prior art devices are the devices invented by Hunt et al, and described in U.S. Pat. Nos. 2,769,191; 3,224,024 and 3,449,782 and the devices invented by the present inventor and described in U.S. Pat. Nos. 3,882,565; 4,153,966 and 4,395,791. These devices, while clearly superior to similar units on the market, nevertheless lack some versatility in that the feed rollers, which have helically grooved peripheries, cannot be removed from the feed device and cannot be rotated therewithin to enable the automatic withdrawal of the snake from the waste line. Accordingly, with the devices of the aforementioned patents, the motor driving the drum which houses the snake must be reversed in order to change the direction of travel of the snake and withdraw it from the waste line.

Certain types of prior art devices have attempted to feed and withdraw the snake by using cooperating smooth surfaced rollers, the angle of rotation of which can be varied relative to the longitudinal axis of the snake. For example, by placing two or more roller wheels at one angle, a rotating spring can be urged forwardly. By placing the roller wheels at a different angle the spring can be urged rearwardly or in a reverse direction. Exemplary of such devices is that shown in British Patent specification No. 1,198,746.

The smooth roller systems, however, require the exertion of significant downward pressure on the spring by the wheels. The exertion of too much pressure can 'bind' the spring and too little pressure can cause undue slippage. Such rollers, therefore, do not perform satisfactorily in cleaning out difficult blockages. On the other hand, where helically grooved rollers are used the exertion of only a minimum amount of pressure on the coiled spring by the rollers will cause uniform feeding the of spring without binding or slippage. Accordingly, the helically grooved rollers perform in a superior fashion to clean out even the most difficult of blockages.

For the aforementioned reasons it is apparent that for some cleanout opertions it is advantageous to use the smooth roller type of system, while in other operations it is advantageous to use the grooved helical roller system. Prior to the present system, two separate machines embodying different feed systems were necessary to achieve this maximum efficiency and versatility. However, the present invention corrects this deficiency by providing for the first time a highly novel apparatus which permits the operator to select the roller configuration best suited for the particular cleanout job.

In several instances, other than situations including severe blockages, the advantages offered by interchangeability of roller sets is apparent. For example, when cleaning waste lines extending between several floors of a high-rise structure, many feet of snake may be introduced into downwardly extending waste lines. Due to the extreme weight of the snake, the smooth roller sets cannot impart enough friction on the snake to raise it as it is withdrawn from the waste lines. Accordingly, in such instances, it is highly advantageous to be able to replace one or more of the smooth rollers with helically grooved rollers which are readily capable of lifting the length of snake.

In cleanout situations when the snake encounters little to medium resistance due to blockages, the smooth rollers can effectively be used. Under these conditions the smooth rollers can be angularly adjusted relative to the longitudinal axis of the snake to increase or decrease the rate of forward or reverse feed of the snake. However, should a severe blockage be unexpectedly encountered, one or more of the smooth rollers can be replaced with a helically grooved roller. With the grooved rollers, the spped of 22 feet per minute feed rate is diminished in direct proportion to the degree of resistance encountered and can range from 0 to 22 feet per minute through the cleanout operation. Such automatic feed rate adjustment is not possible using only the smooth rollers.

In situations wherein it is desired to remove a loose object in the line, it is desirable to replace the grooved rollers with the smooth rollers. This is because with the grooved rollers retrieval of the snake and the object captured by the particular head element attached to the end of the snake can be accomplished only by reversing the motor and, therefore, the direction of rotation of the snake. This reversal of rotation of the snake can cause the head element to "unscrew" or otherwise separate from the object to the withdrawn. However, by replacing the grooved rollers with smooth rollers, the snake and the captured object can be withdrawn by merely changing the angle of the rollers without changing the direction of rotation of the snake. Numerous other operational situations make it highly desirable to be able to interchange the rollers between smooth rollers and helically grooved rollers.

Another imortant advantage of the apparatus of the present invention is the ability of the operator to expeditiously remove the snake and drum housing as a unit and replace them with a new drum housing containing the same or a different size snake. Because of the slotted open design of the housing which carries the feed roolers, the snake can be easily removed from the housing without the necessity of removing the complete feed assembly. This feature enables the ready removal of the drum and snake assembly from the cleanout apparatus whenever the snake is damaged or whenever a larger or smaller diameter snake is required for the particular cleanout job.

SUMMARY OF THE INVENTION

It is an object of the present invention to provide a plumbing tool of the type employing an elongated coiled spring wire, or snake, which is rotated and fed into drain pipes and the like, in which there is provided a novel spring loaded snake feed mechanism adapted to removably carry either smooth surfaced rollers or rollers having helically grooved surfaces.

It is another object of the invention to provide a feed device as described in the preceding paragraph in which the feed mechanism includes control means for simultaneously adjusting the angle at which the rollers engage the spring or snake so that the spring can be fed forwardly or can be reversed without reversing the drive motor.

Another object of the invention is to provide a device of the aforementioned character which, with the helically grooved rollers in place, automatically feeds the snake at a significantly faster rate of speed than is achieved with conventional jaws for any given rotation speed of the snake.

It is still another object of the invention to provide a device of the character described in which the feed mechanism includes alternately selectable feed rollers having either smooth or grooved surfaces which are movable into and out of driving engagement with the snake and one which further includes a biasing mechanism for yieldably urging the feed rollers into driving engagement with the snake which is so constructed and arranged as to exert minimum pressure on the coiled spring and to permit the feed rollers to accommodate distortions and irregularities in the snake and to move out of driving engagement with the snake in response to forces opposing feeding of the snake axially of itself.

It is a further object of the invention to provide a device as described in the preceding paragraph in which the biasing mechanism is adjustable so that the force exerted thereby to hold the feed rollers in driving engagement with the snake may be controllably varied.

Yet another object of the invention is to provide a device of the class described in which the housing assembly carrying the rollers is of a unique slotted design to enable the expeditious removal of the entire drum and snake assembly of the apparatus.

It is still a further object of the invention to produce a novel, low-cost, lightweight feed means which is relaltively simple in design and can be readily attached to both hand held and wheel mounted tools presently on the market, and which can easily be operated. In this connection it is an object to provide such a means which can be readily engaged or disengaged by the operator with very little effort and without any particular skill.

These and other objects will be apparent from the drawings and the following description.

BRIEF DESCRIPTION OF THE DRAWINGS

FIG. 3 is an enlarged fragmentary cross-sectional view taken along lines 3—3 of FIG. 1 showing the internal construction of the feed control device of this form of the invention.

FIG. 4 is a fragmentary cross-sectional view taken along lines 4—4 of FIG. 2 illustrating the construction of a portion of the control means of the invention for simultaneously rotating the roller assemblies of the apparatus to controllably vary the angle between the axes of rotation of the rollers and longitudinal axis of the snake.

FIG. 5 is a cross-sectional view similar to FIG. 4, but illustrating the use of the control means to vary the angle of the roller with respect to the longitudinal axis of the snake.

FIG. 6 is a cross-sectional view taken along lines 6—6 of FIG. 2.

DESCRIPTION OF ONE EMBODIMENT OF THE INVENTION

Figure 1:
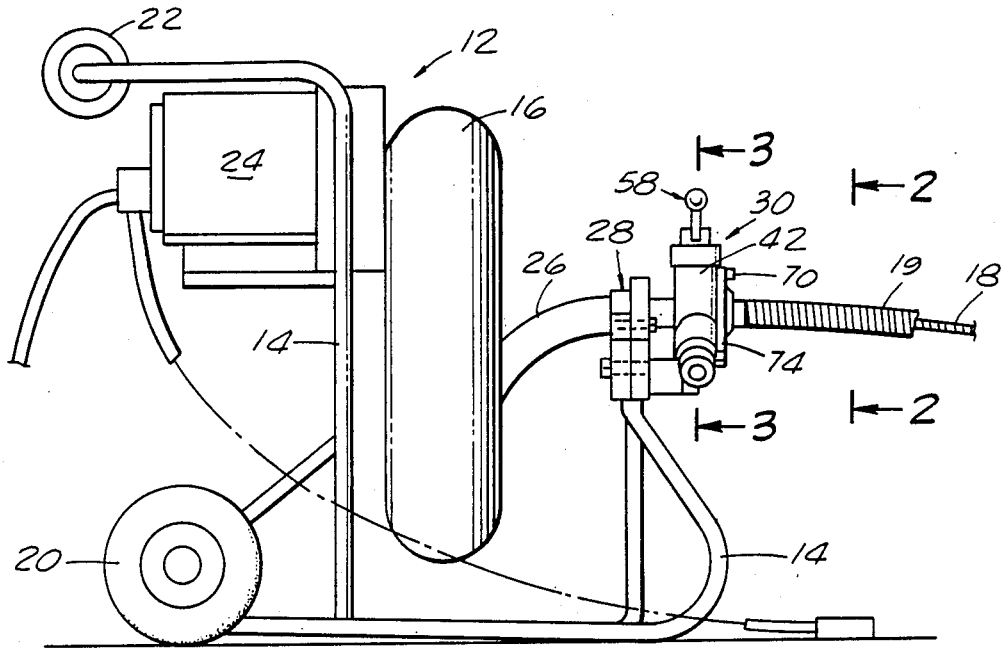
FIG. 1 is a side elevational view of the waste line cleanout apparatus of the present invention.
Figure 2:
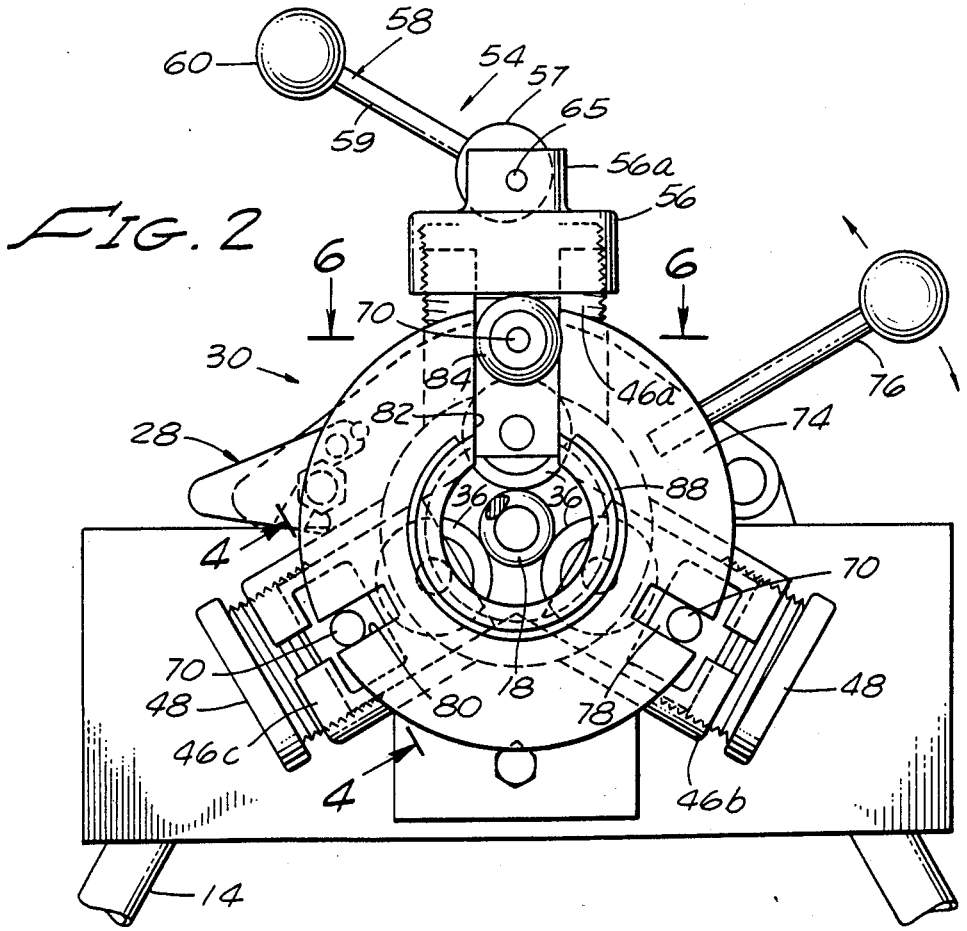
FIG. 2 is a enlarged fragmentary front elevational view taken along lines 2—2 of FIG. 1.
Figure 7:
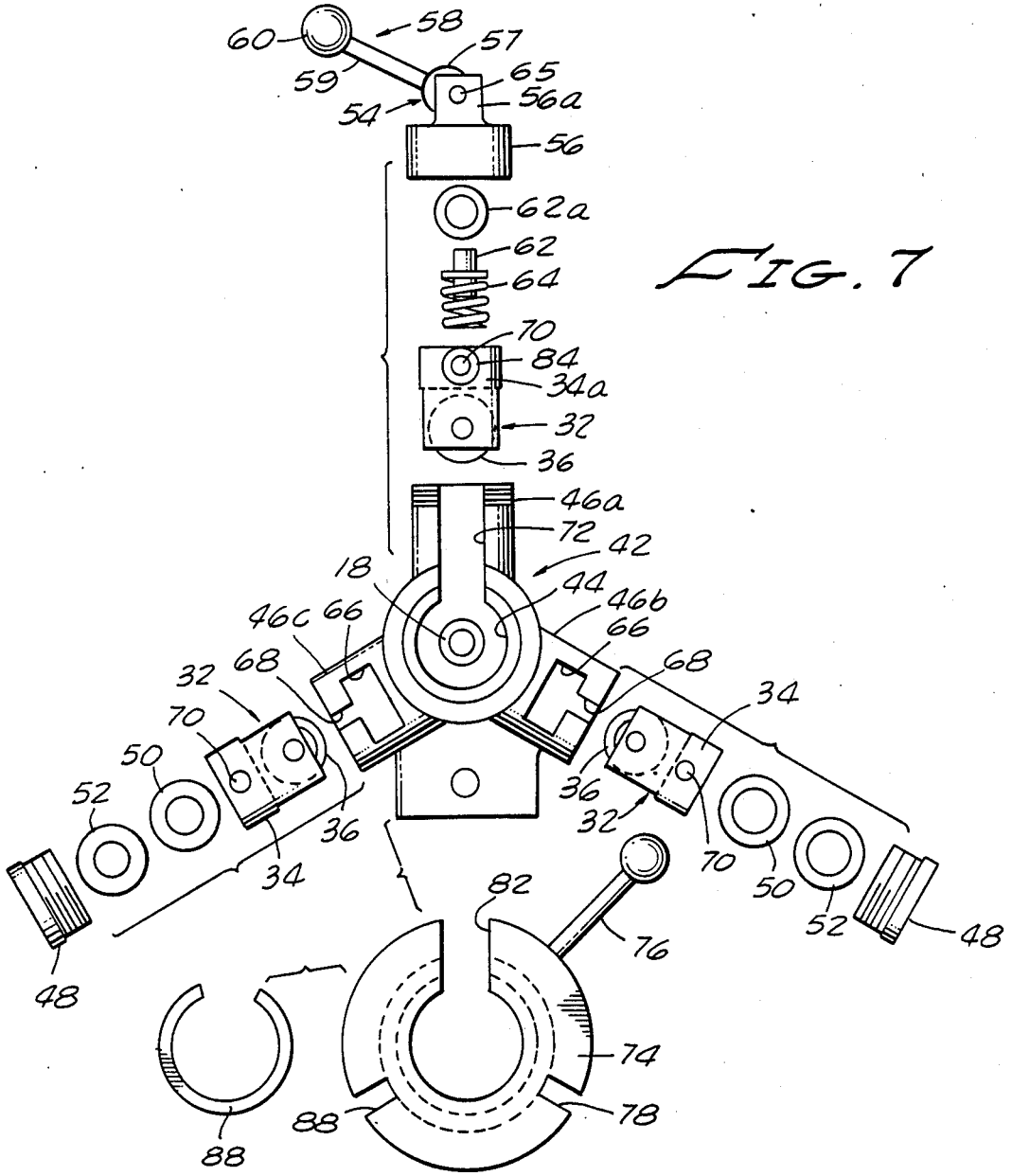
FIG. 7 is a exploded view further illustrating the construction of the feed control device of one embodiment of the invention.

Referring to the drawings, and particularly to FIGS. 1, 3 and 7, the waste line cleanout apparatus of this form of the invention is generally designated in FIG. 1 by the numeral 12. The apparatus comprises a supporting frame 14, a rotatable drum 16 removably carried by frame 14 and an elongated coil spring, or snake, 18, a portion of which is adapted to be carried within drum 16 for controllable withdrawal therefrom so that the withdrawn portion of spring 18 rotates about its longitudinal axis during rotation of the drum 16. Also carried by frame 14 are wheels 20 and 22 for rollably supporting the frame during transport and an electric motor means 24 interconnected with drum 16 for rotating said drum at a controlled rate of speed.

The coiled spring, or snake, 18 is normally stored in a coiled configuration within drum 16 and is withdrawn therefrom through a curved passageway 26 which is connected to drum 16 and secured to frame 14 by a hingably mounted collar assembly 28. As best seen by referring to FIG. 3, collar assembly 28 is hingably movable from the locked postion shown in the solid lines in FIG. 3 to the open position shown in the phantom lines in FIG. 3. With the locking collar means in the open position, the entire drum assembly can be removed from the frame 14 and replaced with another drum assembly having a snake of the same diameter or, if desired, different diameter. A flexible tubular shaped personnel shield 19 is provided about the snake at the location where the snake is inserted into the waste line.

Figure 8:
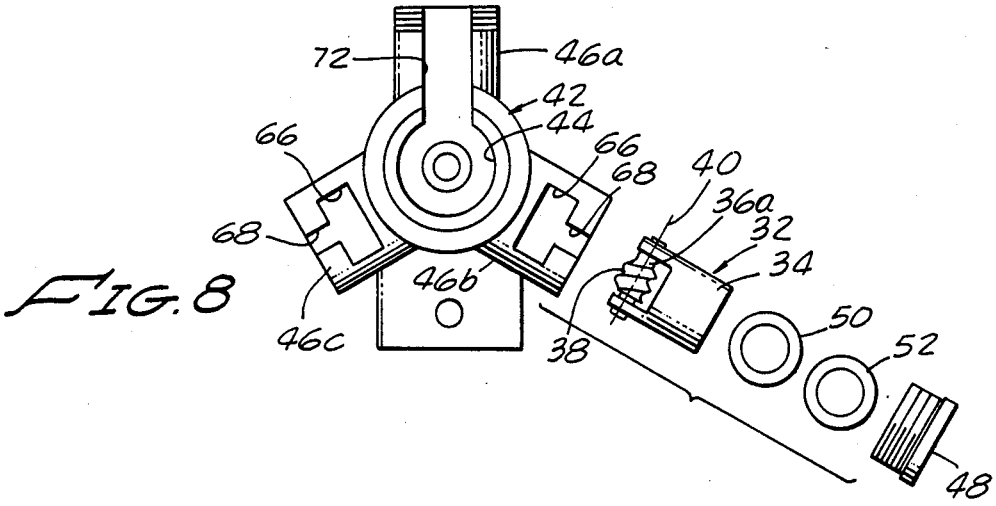
FIG. 8 is a fragmentary exploded view similar to that shown in FIG. 7, but indicating the replacement of smooth roller assemblies with grooved roller assemblies.

Forming an important feature of the apparatus of the present invention is the feed control device, generally designated by the numeral 30, which functions to controllably feed the snake 18 either forwardly out of the drum 16, or rearwardly into a coiled relationship within the drum. Referring to FIGS. 3, 7 and 8, the feed control device of the form of the invention thereshown comprises six roller assemblies 32, each of which comprises a body portion 34 and a roller rotatably carried by the body portion 34. Three of the rollers, designated in the drawings by the numeral 36, have smooth peripheral surfaces (see FIG. 7), and three designated by the numeral 36*a*, have helically grooved peripheral surfaces of the character shown in FIG. 8. While only one roller assembly 34 is shown in FIG. 8, it is to be understood that three roller assemblies identical to that shown in FIG. 8 comprise a part of the feed control device.

Feed rollers 36*a* are of unique design with each being formed to provide peripheral helical channels or grooves 38 which have the same pitch as the coils of the snake 18 and which are adapted to engage the snake when the feed control device is in its closed driving position. Each feed roller 36*a* is freely rotatable in either direction about the axis of axles 40 (FIG. 8) caried by body portion 34. To effectively increase the rate of feed or retraction of the snake, the lead of the helical grooves of the feed rollers 36*a* may be increased to provide, in effect, a double or triple thread or coil advance. When the snake 18 is rotated by the rotation of drum 16, rollers 36*a* will rotate in opposite directions, urging the snake either to feed forwardly or to retract depending upon the direction of rotation of the drum. To control the direction of travel of snake when the grooved rollers are used, the direction of rotation of the drum is controlled by placing motor 24 in a forward or reverse operating condition.

When feed rollers 36*a* are replaced with feed rollers 36, which are of the configuration shown in FIGS. 3 through 7, pressural engagement of the feed rollers against the snake 18 will also cause the snake to feed forwardly or rearwardly as drum 16 is rotated. However, when the smooth rollers are used the snake is fed forwardly or outwardly from drum 18 or is retracted into drum 18 merely by varying the angle of the roller 36 with respect to the longitudinal axis of the snake 18. Accordingly, when the smooth feed rollers 36 are used, the direction of travel of the snake can be reversed by changing the angle of the rollers rather than by reversing the direction of rotation of the motor 24. This feature is advantageous in certain types of cleanout operations where the blockages are light and the weight of the snake to be lifted is small.

Referring again particularly to FIGS. 3 and 7, the feed control device of the invention further comprises roller assembly carrying means for carrying a selected three of the six roller assemblies. In the embodiment of the invention shown in the drawings, the roller assembly carrying means comprises a roller assembly housing 42 adapted to be mounted at the forward portion of frame 14. Housing 42 is provided with a central aperture 44 adapted to receive coiled spring 18 and includes three radially outwardly extending hollow casings 46*a*, 46*b* and 46*c* which are circumferentially spaced about coiled spring 18. As indicated in the drawings, the circumferentially spaced housings 46*a*, 46*b* and 46*c* are equally spaced apart and are adapted to removably carry any three of the selected roller assemblies 34 of the feed control device.

As best seen in FIG. 3 and 7, casings 46*b* and 46*c* are internally threaded and the roller assemblies 34 disposed therein are maintained in position by externally threaded cap portions 48. Cooperating roller bearings and thrust washers 50 and 52, which are adapted to be disposed between the roller assemblies and the interior surfaces of the caps 48, function to permit easy rotation of the roller assemblies with the casings. It is apparent that due to the threaded configuration of the casings and of the caps 48, roller assemblies 34 can be readily axially adjustable within the casings with respect to snake 18 and can be easily and quickly removed for replacement with roller assemblies of the grooved roller configuration. As previously discussed herein, the nature of the cleanout task governs whether all smooth rollers, all grooved rollers, or a combination of rollers is to be used.

Forming another important aspect of the feed control device of the present invention is actuating means carried by housing 42 for operable interaction with one of the roller assemblies for moving the roller carried thereby into pressural engagement with the coiled spring 18. In the instant form of the invention, this actuating means comprises a manually operated cam assembly 54 which is operably coupled with the particular roller assembly housed within casing 46*a*. As best seen in FIG. 3, casing 46*a* is externally threaded to threadably receive an internally threaded cap 56 which includes a yoke-like protuberance 56*a* adapted to rotatably carry cam assembly 54. Cam assembly 54 comprises a cam member, or element 57 and an operating handle 58 which includes a lever arm 59 and a gripping portion 60.

Also forming a part of the actuating means of the invention is a biasing means for yieldably urging the roller carried by the roller assembly disposed within casing 46*a* into pressural engagement with the snake. As best seen in FIG. 3, this biasing means comprises a cylindrical rod 62 which is operably interconnected with a coil spring 64. The upper end of rod 62 protrudes through a washer 62*a* and through a central aperture 63 formed in cap 56 for operable engagement with cam element 57. The shape of cam element 57 is such that upon rotation of the cam element about an axle pin 65 carried by yoke 56*a*, connecting rod 62 can be moved from a first elevated position wherein spring 64 is substantially relaxes to a second lowered position wherein spring 64 is compressed. Because the lower portion of spring 64 is maintained in engagement with the upper surface of the roller assembly which is carried within casing 46*a*, activation of the cam assembly will cause the roller move downwardly within casing 46*a* to a position wherein the roller carried thereby is in pressural engagement with the snake 18.

Due to the novel configuration of the actuating means of the invention as thus described and the ease with which cap 56 can be removed from casing 46*a*, replacement of the roller assembly carried therewithin can be quickly and easily accomplished so that either a smooth faced roller, or a helically grooved roller can be selectively used for any particular cleanout operation. Similarly, the expeditious removal of the internally threaded caps 48 permit the quick and easy replacement of the roller assemblies carried with casings 46*b* and 46*c*.

Another highly important feature of the roller assembly housing 42 of the present invention resides in its slotted configuration. As best seen by referring to FIG. 7, casings 46*b* and 46*c* are provided with generally T-shaped slots having a transversely extending portion 66 and a longitudinally extending portion 68. Slot 68 is of a width to closely accept transversely extending pins 70 which extend outwardly from those roller assemblies 34 carrying the smooth rollers 36. When those roller assemblies are in position with their respective casings, transversely extending slots 66 provide clearance to pins 70 so as to permit rotational movement of the roller assemblies within the casing in the manner illustrated in FIG. 4 and 5. As will be discussed in greater detail in the paragraphs which follow, it is this movement of the roller assemblies 34 within their respective casing that permits regulation of the rate of feed of the spring 18 from or into the rotating drum 16.

Turning to FIGS. 6 and 7, it can be seen that casing 46*a* of the housing is provided with a wider longitudinally extending slot 72. Slot 72 is of a width to permit removal of the spring 18 from the housing through the slot 72. This wider slot 72, also provides clearance to radially extending pin 70, affixed to the roller assembly which is disposed in casing 46*a* (designated by the numeral 34*a* in FIG. 7).

Forming a part of the control means of the invention, which functions to simultaneously rotate the roller assemblies within their respective casings so as to vary the angle between the axes of rotation of the rollers and the longitudinal axis of the snake is a generally disc shaped member 74. Disc shaped member 74 is rotatably carried by housing 42 for rotation in either a clockwise or counter-clockwise direction. A handle assembly 76 is provided on member 74 for this purpose. As best seen in FIG. 7, member 74 is provided with three circumferentially spaced slots 78, 80 and 82. Slots 78 and 80 are of a width so as to closely receive the pins 70 which extend radially outwardly from the roller assemblies carrying the smooth rollers 36. Slot 82, on the other hand, corresponds in width to slot 72 formed in housing 42 so as to permit passage of the snake 18. Slot 82 is of a width to also closely receive a head portion 84 provided on the pin 70 shown in FIG. 6. The provision of this enlarged diameter head portion on the pin 70 associated with the roller assembly carried in casing 46*a* is to operationally accommodate the wider slot 82 provided in member 74. Disc shaped member 80 is maintained in engagement with housing 42 by means of a split spring or keeper 88 (FIG. 7).

By referring to FIGS. 4, 5 and 6, it can be seen than upon rotation of disc member 74 relative to housing 42, the various roller assemblies will be rotated within their respective casings and the pins 70, which extend through the slots 78 and 80, formed in member 74, will move from a position in alignment with snake 18 (FIG. 4) to an angularly disposed position as shown in FIG. 5. Of course, this rotation of the roller assemblies also causes the rollers carried thereby to move angularly with respect to the longitudinal axis of the snake. In a similar manner, as illustrated in FIG. 6, rotation of disc member 74 will cause the slot 82 to engage the head portion 84 of the pin 70 shown in this Figure and the pin, along with the roller, will move angularly with respect to the longitudinal axis of the snake.

When the smooth surfaced rollers 36 are in place within the housing 42, adjustment of the angular relation between the axes of rotation of the rollers and the longitudinal axis of the snake 18 is accomplished by rotational movement of the disk member 74 using the handle assembly 76. This adjustment of the angular orientation of the rollers provides control over the rate of feed of the snake as well as control of the direction of feed of the snake. For example, when the axis of rotation of the roller is in alignment with the axis of the snake 18 as shown in FIG. 4, the snake 18 will merely rotate under the influence of the motor 24 and will not be either fed or retracted. With the rollers in this position, the snake can continue to rotate and work on an obstruction in the waste line in an idle-like operational mode. However, when the roller assembly is moved to the position shown in FIG. 5 as a result of rotation of the disc member 74, and the axis of rotation of the roller is rotated out of parallel relationship with the snake, the snake will be fed or retracted depending upon the direction of rotation of the snake about its own axis. For example, if the snake, as viewed from the right in FIG. 5, is rotating in a clockwise direction, the movement of the roller into the angular position shown in Figure 5 will cause the snake to be fed forwardly, or to the right as viewed in FIG. 5. Obviously if the control means of the invention is rotated in the opposite direction whereby the angle of rotation of the roller relative to the longitudinal axis of the snake is reversed, the snake will be retracted, or will move to the left as viewed in FIG. 5. By varying the size of the angle of the roller with respect to the longitudinal axis of the snake, the speed of either feeding or retraction of the snake can be precisely controlled. As previously mentioned, this ability to control the feed and diretion of travel of the snake during the cleanout operation without reversing the motor 24 has advantages in those situations, such as the cleaning of light obstructions, where the smooth rollers can be used in lieu of the grooved rollers.

It is, of course, apparent that when the grooved rollers are used, the control means is inoperative to regulate the speed or direction of trvel of the snake. In this configuration of the apparatus, control over the direction of feed of the snake is accomplished by reversing the direction of rotation of the electric motor 24.

As a result of the just described construction, it is apparent that the apparatus of the present invention has all of the advantages inherent in machines of the type adapted to use smooth rollers as well as of machines of the type adapted to use helically grooved rollers. By the simple expedient of replacing all or some of the roller assemblies within the casings of the housing 42, the device of the invention can quickly be converted into whichever type of apparatus is most desirable for the particular cleanout operation at hand. It is also apparent that with the unique construction of the feed device of the invention as described, the snake and drum assembly can readily be removed from the device without the necessity of removing the feed control and can be replaced with a drum and snake assembly embodying either a larger or smaller diameter snake as may be required.

Figure 9:
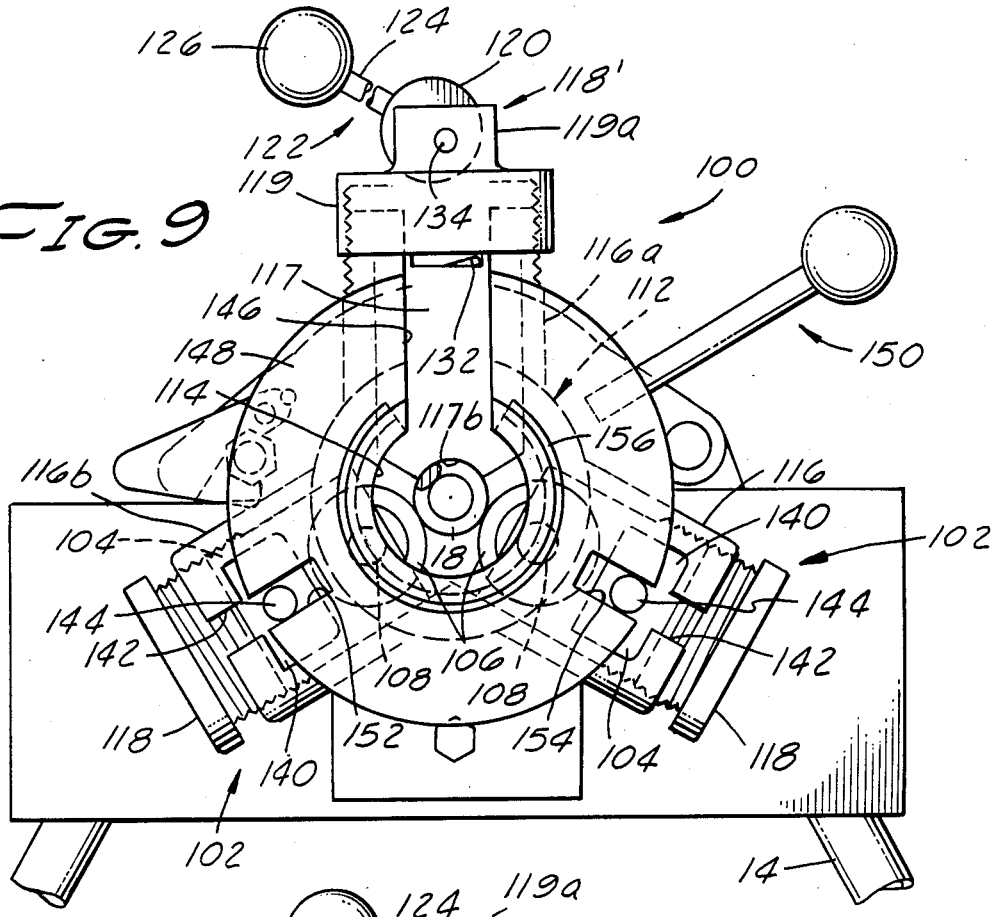
FIG. 9 is an enlarged, fragmentary front elevational view of an alternate form of feed control device of the present invention.
Figure 10:
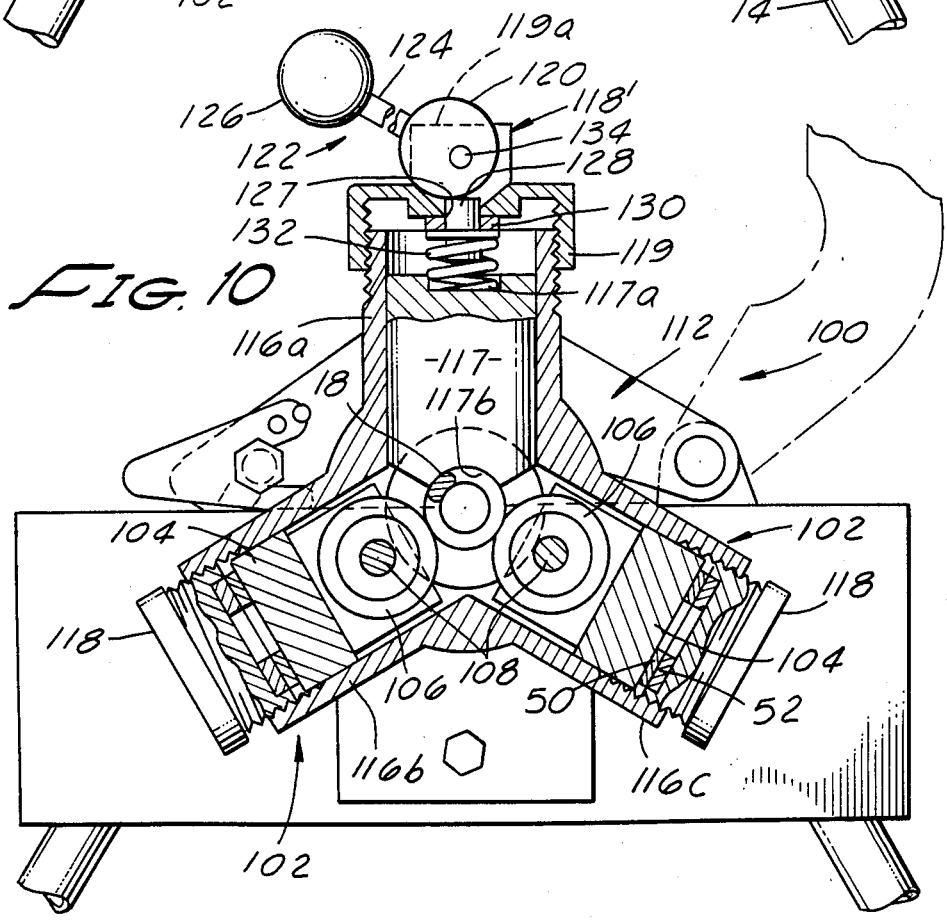
FIG. 10 is an enlarged fragmentary cross-sectional view, similar to FIG. 3, showing the internal construction of the alternate form of feed control device shown in FIG. 9.

Turning to FIGS. 9 and 10 of the drawings, there is shown an alternate form of the feed control device, generally designated by the numeral 100. As in the case of the earlier described form of feed control device, this alternate device functions to controllably feed the snake 18 either forwardly out of the drum 16, or rearwardly into a coiled relationship within the drum. The feed control device of this alternate form of the invention comprises four roller assemblies 102, each of which comprises a body portion 104 and a roller rotatably carried by the body portion 104. Two of the rollers, designated in the drawings by the numeral 106, have smooth peripheral surfaces, and two have helically grooved peripheral surfaces of the character shown in FIG. 8 and identified by the numeral 38.

Each feed roller 106 is freely rotatably in either direction about the axis of axles 108 carried by body portion 104. When helically grooved rollers are used and it is desired to effectively increase the rate of feed or retraction of the snake, the lead of the helical grooves of the feed rollers may be increased to provide, in effect, a double or triple thread or coil advance. When the snake 18 is rotated by the rotation of drum 16, the rollers will rotate in opposite directions, urging the snake either to feed forwardly or to retract depending upon the direction of rotation of the drum. To control the direction of travel of snake when grooved rollers are used, the directio of rotation of th drum is controlled by placing motor 24 in a forward or reverse operating condition.

When the helically grooved feed rollers are replaced with smooth feed rollers which are of the configuration shown in FIGS. 3 through 7, pressural engagement of the feed rollers against the snake 18 will also cause the snake to feed forwardly or rearwardly as drum 16 is rotated. However, when the smooth rollers are used the snake is fed forwardly or outwardly from drum 16 or is retracted into drum 16 merely by varying the angle of the roller with respect to the longitudinal axis of the snake 18. Accordingly, when the smooth feed rollers are used, the direction of travel of the snake can be reversed in the manner previously described herein by changing the angle of the rollers rather than by reversing the direction of rotation of the motor 24.

As indicated in FIGS. 9 and 10, the feed control device of this alternate form of the invention further comprises carrying means for carrying a selected two of the four roller assemblies. the carrying means comprises a roller assembly housing 112 adapted to be mounted at the forward portion of frame 14. Housing 112 is provided with a central aperture 114 adaptd to receive coiled spring 18 and includes three radially outwardly extending hollow casing 116*a*, 116*b* and 116*c* which are circumferentially spaced about coiled spring 18. As indicated in the drawings, the circumferentially spaced casing 116*a*, 116*b* and 116*c* are equally spaced apart. Casings 116*b* and 116*c* are adapted to removably carry two of the selected roller assemblies of the feed control device. However, casing 116*a* is adapted to removable carry a spring engaging means, the purpose and operation of which will presently be described.

Casings 116*b* and 116*c* are internally threaded and the roller assemblies disposed therein are maintained in position by externally threaded cap portions 118. Cooperating roller bearings and thrust washers 50 and 52, which are adapted to be disposed between the roller assemblies and the interior surfaces of the caps 118, function to permit easy rotation of the roller assemblies with the casings. It is apparent that due to the threaded configuration of the casings and of the caps 118, the roller assemblies can be readily axially adjustable within the casings with respect to snake 18 and can be easily and quickly removed for replacement with roller assemblies of another configuration. As previously discussed herein, the nature of the cleanout task governs whether all smooth rollers or all grooved rollers, are to be used.

Forming an important aspect of the feed control device of this alternate form of the present invention is the previously mentioned spring engaging means carried by casing 116*a* for engagement with the snake to urge it into driving engagement with the rollers carried by casings 116*b* and 116*c*. This means is here provided in the form of a generally cylindrically shaped member 117 having a counterbore 117*a* (FIG. 10) in its upper end and having a smooth concave portion 117*b* formed at the lower end thereof. An actuating means of the character previously described is carried by housing 112 for operable interaction with the spring engaging means, or member 117 for moving the concave surface 117*b* thereof into pressural engagement with the coiled spring 18. As was the case in the previously described form of the invention, this actuating means comprises a manually operated cam assembly 118. However, this cam assembly is operably coupled with member 117 which is housed within casing 116*a*. As best seen in FIG. 10, casing 116*a* is externally threaded to threadably receive an internally threaded cap 119 which includes a yoke-like protuberance 119*a* adapted to rotatably carry cam assembly 118. Cam assembly 118 comprises a cam member, or element 120 and an operating handle 122 which includes a lever arm 124 and a gripping portion 126.

As seen in FIG. 10, cap 119 is provided with a central aperture 127 which closely receives a pin 128. Also forming a part of the actuating means of this form of the invention, is a bearing 130 which is associated with pin 128 and a biasing means for yieldably resisting radially outward movement of member 117. This biasing means here comprises a coil spring 132 which surrounds a lower portion of pin 128. The upper end of pin 128 protrudes through bearing 130 and through the central aperture 127 formed in cap 56 for operable engagement with cam element 120. The shape of cam element 120 is such that upon rotation of the cam element about an axle pin 134 carried by yoke 119*a*, pin 127 along with bearing 130 can be moved from a first elevated position wherein spring 132 is substantially relaxed and member 117 is in non-driving engagement with the snake to a second lowered position wherein spring 132 is compressed and member 117 is in driving pressural engagement with the snake. Because the lower portion of spring 132 is maintained in engagement with the counterbore formed in the upper surface of member 117 which is carried within casing 116*a*, activation of the cam assembly will cause member 117 to move downwardly within casing 116*a* to a position wherein the concave surface 117*b* thereof is in driving pressural engagement with the snake 18 urging the snake into pressural engagement with the rollers. The degree of pressure exerted by member 117 against the snake can be regulated by threading cap 119 in a clockwise or counterclockwise direction with respect to casing 116*a*. Spring 132 is selected so that when member 117 is in driving pressural engagement with the snake the rollers will positively drive the snake. However, spring 132 is such that if an obstruction is encountered, or if a kink or other deformation in the snake is encountered, member 117 can move radially outwardly against the urging of the spring.

Another extremely important feature of the roller assembly housing 112 of this form of the invention resides in its slotted configuration. As best seen by referring to FIG. 9, casings 116*b* and 116*c* are provided with generally T-shaped slots having a transversely extending portion 140 and a longitudinally extending portion 142. Slot 12 is of a width to closely accept transversely extending pins 144 which extend outwardly from those roller assemblies carrying the smooth rollers. When those roller assemblies are in position with their respective casings, transversely extending slots 140 provide clearance to pins 144 so as to permit rotational movement of the roller assemblies within the casing. As previously discussed herein, it is this movement of the smooth roller assemblies within their respective casings that permits regulation of the rate of feed of the spring 18 from or into the rotating drum 16.

It is important to note that casing 116*a* of the housing is provided with a much wider longitudinally extending slot 146. Slot 146 is of a width to permit removal of the spring 18 from the housing through the slot 146. This is a very important aspect of the invention because by simply threadably removing cap 119 and member 117, the snake 18, along with drum 16, can quickly and easily be removed and replaced with a new drum and snake of the same or different size. With this unique construction, if the snake is damaged, or if a larger snake and drum is needed, replacement can be quickly made in the field without time consuming disassembly of the apparatus and the feed device.

Forming a part of the control means of this form of the invention, which functions to simultaneously rotate the roller assemblies within casing 116*b* and 116*c* so as to vary the angle between the axes of rotation of the rollers and the longitudinal axis of the snake is a generally disc shaped member 148. Disc shaped member 148 is rotatably carried by housing 112 for rotatio nin either a clockwise or counter-clockwise direction. A handle assembly 150 is provided on member 148 for this purpose. Member 148 is provided with two circumferentially spaced slots 152 and 154. Slots 152 and 154 are of a width so as to closely receive the pins 14 which extend radially outwardly from the roller assemblies carrying the smooth rollers. Disc shaped member 148 is maintained in engagement with housing 112 by means of a split spring or keeper 156.

Upon rotation of disc member 148 relative to housing 112, the roller assemblies will be rotated within their respective casings and the pins 144, which extend through the slots 152 and 154, formed in member 148, will move from a position in alignment with snake 18 to an angularly disposed position. Of course, this rotation of the roller assemblies also causes the rollers carried thereby to move angularly with respect to the longitudinal axis of the snake.

When the smooth surfaced rollers are in place within the housing, adjustment of the angular relation between the axes of rotation of the rollers and the longitudinal axis of the snake 18 is accomplished by rotational movement of the disk member 148 using the handle assembly 150. This adjustment of the angular orientation of the rollers provides control over the rate of feed of the snake as well as control of the direction of feed of the snake. For example, when the axis of rotation of the roller is in alignment with the axis of the snake 18, the snake 18 will merely rotate under the influence of the motor 24 and will not be either fed or retracted. With the rollers in this position, the snake can continue to rotate and work on an obstruction in the waste line in an idle-like opertional mode. However, when the roller assemblies are moved to a position wherein the axis of rotation of the roller is rotated out of parallel relationship with the snake, the snake will be fed or retracted depending upon the direction of rotation of the snake about its own axis. By varying the size of the angle of the roller with respect to the longitudinal axis of the snake, the speed of either feeding or retraction of the snake can be precisely controller.

It is, of course, apparent that when the grooved rollers are used, the control means is inoperative to regulate the speed or direction of travel of the snake. In this configuration of the apparatus, control over the direction of feed of the snake is accomplished by reversing the direction of rotation of the electric motor 24. However, it is important to note that because of the novel slotted configuration of casing 116*a*, with either type of roller, the snake and drum assembly can readily be removed from the device without the necessity of removing the feed control and can be replaced with a drum and snake assembly embodying either a larger or smaller diameter snake as may be required.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A feed control device for use with plumbing tools of the type having an elongated coiled spring, or plumbers' snake, and means for rotating the snake about its longitudinal axis, comprising:

(a) two circumferentially spaced roller assemblies, each said assembly comprising a roller and a body portion adapted to rotatably carry said roller;

(b) coiled spring engaging means for pressural engagement with said coiled spring to urge said coiled spring into driving engagement with said rollers, said coiled spring engaging means comprising a coiled spring engaging member movable from a first position wherein said member is not in pressural engagement with said coiled spring to a second position wherein said member is in pressural engagement with said coiled spring; and (c) carrying means for carrying said roller assemblies and said coiled spring engaging means, said means having a central aperture for receiving said coiled spring and comprising three casings circumfmerentially spaced apart about said snake for carrying said roller assemblies and said coiled spring engaging means, one of said casings having a longitudinally extending slot communicating with said central aperture and having a width greater than the diameter of said coiled spring; and (d) actuating means for moving said coiled spring engaging member into pressural engagement with said coiled spring.

2. A feed control device as defined in claim 1 in which said coiled spring engaging member comprises first and second extremities, one of said extremities being provided with a generally concave portion and the other of said extremities being engageable by said actuating means.

3. A feed control device as defined in claim 2 in which said actuating means comprises a manually operated assembly including a reciprocally movable member for engaging said other of said extremities of said coiled spring engaging member.

4. A feed control device as defined in claim 3 in which said manually operated assembly includes a manually operated cam cooperatively associated with said reciprocally movable member.

5. A feed control device for use with plumbing tools of the type having an elongated coiled spring, or plumbers snake, and means for rotating the snake about its longitudinal axis, comprising:

(a) at least four roller assemblies, each said assembly comprising a roller and a boyd portion adapted to rotatably carry said roller, two of said rollers having a smooth peripheral surface and two of said rollers having a plurality of helical grooves formed about the peripheries thereof, said grooves being adapted to mateably engage the snake;

(b) snake engaging means for pressural engagement with said snake to urge said snake into engagement with said rollers;

(c) carrying means for carrying at least two of said roller assemblies and said snake engaging means, said carrying means comprising a housing having a central aperture for receiving said snake and comprising three tubular shaped casings circumferentially spaced equally about said snake, two of said casings being adapted to removably carry a selected two of said roller assemblies and one of said casings being adapted to carry said snake engaging means for movement therewithin from a first position wherein said snake engaging means is in non-pressural engagement with said coiled spring to a second position wherein said snake engaging means is in pressural engagement with said coiled spring;

(d) control means for simultaneously rotating said roller assemblies within said casing to controllably vary the angle between the axes of rotation of said rollers and the longitudinal axis of the snake; and (e) actuating means for moving said snake engaging means from said first position to said second postion.

6. A feed control device for use with plumbing tools of the type having an elongated coiled spring, or plumbers snake, and means for rotating the snake about its longitudinal axis, comprising (a) least two roller assemblies, each said assembly comprising a roller and a body portion adapted to rotatably carry said roller;

(b) coiled spring engaging means for engaging said coiled spring to move said coiled spring into pressural engagement with said rollers, said coiled spring engaging means comprising a coiled spring engaging member movable from a first position wherein said member is not in pressural engagement with said coiled spring to a second postion wherein said member is in pressural engagement with said coiled spring; and (c) carrying means for carrying said roller assemblies and said coiled spring engaging means, said carrying means having a central aperture for receiving said snake and comprising at least two roller assembly casing circumferentially spaced apart about said snake for carrying said roller assemblies, and one casing circumferentially spaced from said roller assembly casings for removably carrying said coiled spring engaging means, said one casing having a radially outwardly extending coiled spring receiving slot communicating with said central aperture and having a width greater than the diameter of the snake, whereby when said coiled spring engaging means is removed from said one casing said snake scan be radially withdrawn from said carrying means for replacement by an alternative snake.

7. A feed control device as defined in claim 7 including actuating means for moving said coiled spring engaging means into pressural engagement with said snake.

8. A feed control device as defined in claim 7 in which said coiled spring engaging means comprises a generally cylindrically shaped member carried by said one casing for reciprocal movement therewithin and in which said feed control device further includes actuating means comprising a manually operated assembly operably coupled with said cylindrically shaped member for controllably moving said member reciprocally within said one casing.

* * * * *